US005215390A

United States Patent [19]

Stempfle

[11] Patent Number: 5,215,390

[45] Date of Patent: Jun. 1, 1993

[54] MATRIX PIN PRINT HEAD

[75] Inventor: Johann Stempfle, Pfaffenhofen, Fed. Rep. of Germany

[73] Assignee: Mannesmann Aktiengesellschaft, Düsseldorf, Fed. Rep. of Germany

[21] Appl. No.: 719,256

[22] Filed: Jun. 21, 1991

[30] Foreign Application Priority Data

Jun. 21, 1990 [DE] Fed. Rep. of Germany ..... 4020010

[51] Int. Cl.[5] ..... B41J 2/23

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,605,323 | 8/1986 | Blanchard et al. | 400/124 |
| 4,629,344 | 12/1986 | Niebel | 400/124 |
| 4,640,633 | 2/1987 | Hebert | 400/124 |
| 4,854,752 | 8/1989 | Rossopoulos | 400/124 |
| 4,929,103 | 5/1990 | Hendrischk | 400/124 |

*Primary Examiner*—Edgar S. Burr
*Assistant Examiner*—Lynn D. Hendrickson
*Attorney, Agent, or Firm*—Horst M. Kasper

[57] ABSTRACT

An electromagnetic drive (5) for longitudinal motions is in each case furnished for each print pin (3) in a matrix pin print head (1). Guide mouthpieces (9), movable back and forth or, respectively, up and down, are furnished for the generation of speed and letter-quality printing. A lifting magnet device (10) serves for two defined end positions of a magnet armature (11). In order to dispose the lifting magnet device (10) within the smallest possible space, i.e. as compact as possible, and in order to improve the switching frequency, the lifting magnet device (10) is altogether disposed and attached, respectively, in a region (15) immediately adjacent to the guide mouthpiece (9) and includes a magnet yoke (17) with two or several magnet poles (18, 19). An armature body (21) is movable back and forth or, respectively, up and down between the predetermined and coordinated distance (20) of two unlike magnet poles (18, 19) by switching on or switching off or by changing polarity of the switched on lifting magnet coil (22). The guide mouthpiece (9) is attached to the guided armature body (21).

21 Claims, 4 Drawing Sheets

MATRIX PIN PRINT HEAD

BACKGROUND OF THE INVENTION

1. Field of the Invention

The invention relates to a matrix pin print head with several print pins, where in each case an electromagnet drive is coordinated to the rear end of the print pins for furnishing longitudinal motions to the print pins, in order to generate print dots on a recording substrate, and where the front ends of the print pins form in each case slots and rows in a back and forth movable or, respectively, up and downward movable guide mouthpiece, and wherein the lifting magnet device is furnished for two defined end positions of a magnet armature.

2. Brief Description of the Background of the Invention Including Prior Art

Such matrix pin print heads serve for obtaining a higher resolution of print dots in a matrix system and thus for calligraphic and letter-quality printing in addition to speed printing.

In principle, two side-by-side existing structures are known for the alternating letter-quality printing and speed printing. A print head, furnished with two parallel pin slots, is turned around a middle longitudinal axis, running about parallel to the print pins. Thereby, the print pins of one pin slot print print dots between the print dots of the forwardly moved pin slot, whereby the print dots are also printed overlappingly. The second mode of construction is as follows. One of the two pin slots is shifted relative to the other pin slot, for example, to half the pin spacing. The present invention relates to the shifting of a first pin slot in relation to a second pin slot, i.e. it relates to the second kind of structure. It is also possible to print with only one shiftable pin slot, however, at least two print passes per line are then necessary such that the print head works slower.

Pin-slot adjustment devices based on lifting magnets are known from the European Printed Patent Document EP 0,314,851; German Printed Patent Document DE 3,540,761; German Printed Patent Document DE 3,412,856; German Printed Patent Document 3,412,854; German Printed Patent Document DE 3,403,795; German Printed Patent Document DE 2,660,934; European Printed Patent Document 052,066; U.S. Pat. No. 4,640,633. The known constructions require a relatively large space, because they use generally very long lever arms to which the guide mouthpiece is attached. On the other hand, the known large moved masses require correspondingly high switching forces as well as restoring forces which are generated in most cases on the basis of a spring force.

SUMMARY OF THE INVENTION

1. Purposes of the Invention

It is an object of the present invention to furnish a pin-slot adjustment device with a smaller required device space and with small switching forces.

These and other objects and advantages of the present invention will become evident from the description which follows.

2. Brief Description of the Invention

According to the present invention there is provided for a matrix pin print head with several print pins. Each print pin includes a front end and a rear end. An electromagnetic drive is coordinated to each rear end of the print pin for generating a longitudinal motion of the print pin in order to generate print dots on a recording substrate. Slots are formed in a guide mouthpiece by the front ends of the print pins. Said guide mouthpiece is furnished with motions. A magnet armature has two defined end positions. A lifting magnet device is furnished for the two defined end positions of the magnet armature. A magnet yoke has at least two magnet poles and is furnished at the lifting magnet device. The two magnet poles are unlike magnet poles and include a determined and coordinated distance spacing. An armature body performs motions within the distance spacing between the two unlike magnet poles. The motions are generated in that a back and forth motion is performed by switching on and off of the lifting magnet coil and in that an up and down motion is performed by a change in polarity of the switched-on lifting magnet coil. The lifting magnet device is altogether disposed and attached in a region immediately adjacent to the guide mouthpiece. The guide mouthpiece is attached at the guided armature body. The guide mouthpiece is thereby imparted with the motions of the armature body.

The lifting magnet device can be disposed altogether within a matrix print head casing between a frontmost one of print pin guide supports and the guide mouthpiece.

An E-shaped yoke including a center yoke arm can be disposed in the stroke magnet device. The center yoke arm of the E-shaped yoke can support the lifting magnet coil.

A permanent magnet can be furnished at the armature body of the lifting magnet device. The lifting magnet coil can be changed in polarity.

A mouthpiece support can be hingedly attached at the magnet yoke.

At least two parallel running arms can be formed at the mouthpiece support. A rocker in each case rigidly can be connected to the armature body and to the guide mouthpiece. The parallel running arms can be hingedly attached to the rocker and to the magnet yoke.

Film hinge joints can form in each case hinge positions within the two parallel running arms of the mouthpiece support. The mouthpiece support can be formed of one single piece made of an elastic material.

The guide mouthpiece can be adhesively attached in the mouthpiece support.

In accordance with the present invention, the lifting magnet device in its entirety is disposed and attached, respectively, in the immediate region relative to the guide mouthpiece. The lifting magnet device exhibits a magnet yoke with two or more magnet poles. An armature body is movable back and forth or, respectively, up and down, between the predetermined and fixed distance of two unlike magnet poles by switching on and switching off or by changing polarity of the switched on lifting magnet coil. The guide mouthpiece is attached at the guided armature body. An advantage of this structure is a small device size of the complete lifting magnet device so that this small-sized lifting magnet device can be disposed left or right of the print head without interfering with and impairing the inspection of the printed text by the user. Furthermore, precisely determined end positions of the guide mouthpiece are assured for the relation and only small switching forces are required for the actuation of the system. The system, however, furnishes in addition an extremely high adjustment safety because the distance of two unlike magnet poles can be machine-made with high tolerances.

The invention matrix pin print head can, however, be constructed spatially so compact and small that the complete lifting magnet device is disposed within a matrix print head casing between the frontmost print pin guide support and the guide mouthpiece.

According to further advantageous embodiments, it is provided that the lifting magnet device exhibits an E-shaped yoke, where the center yoke arm supports the lifting magnet coil. Thus, this measure also supports a better use of the space. In addition, the magnet fluxes are guided advantageously.

A further advantageous embodiment comprises that the armature body of the lifting magnet device is furnished with a permanent magnet, where the lifting magnet coil can be changed in polarity. This electrical change of polarity requires very small switching forces wherein, restoring forces furnished by mechanical springs can be fully dispensed with in this case. In addition, only a small self-heating of the lifting magnet coil occurs during a simple change of polarity such that a high switching number and switching frequency can be used.

It is an additional feature of the invention that a mouthpiece support is hingedly attached at the magnet yoke. This device component as well adapts itself to the magnet yoke in the outer shape and, consequently, requires neither space nor increases the transport weight of the matrix pin print head.

According to a further advantageous embodiment, the mouthpiece support exhibits at least two parallel running arms, which are hingedly attached at a rocker and at the magnet yoke. The rocker is in each case rigidly connected to the armature body and to the guide mouthpiece. The armature body with guide mouthpiece can move without overcoming the restoring forces between the unlike magnet poles of the magnet yoke based on this rocker.

According to a further improvement of the invention, the mouthpiece support is made of one piece and of an elastic material and the hinge positions are formed by so-called film hinge joints. This solution allows an absolute arc-free adjustment of the guide mouthpiece, in the sense of a parallelogram.

Finally, it is provided that the guide mouthpiece is adhesively hingedly attached in the mouthpiece support. An alignment of the adjustable pin slots relative to the remaining print head parts such as, for example, to a second free-standing pin slot, can be performed during the assembly of the lifting magnet device.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
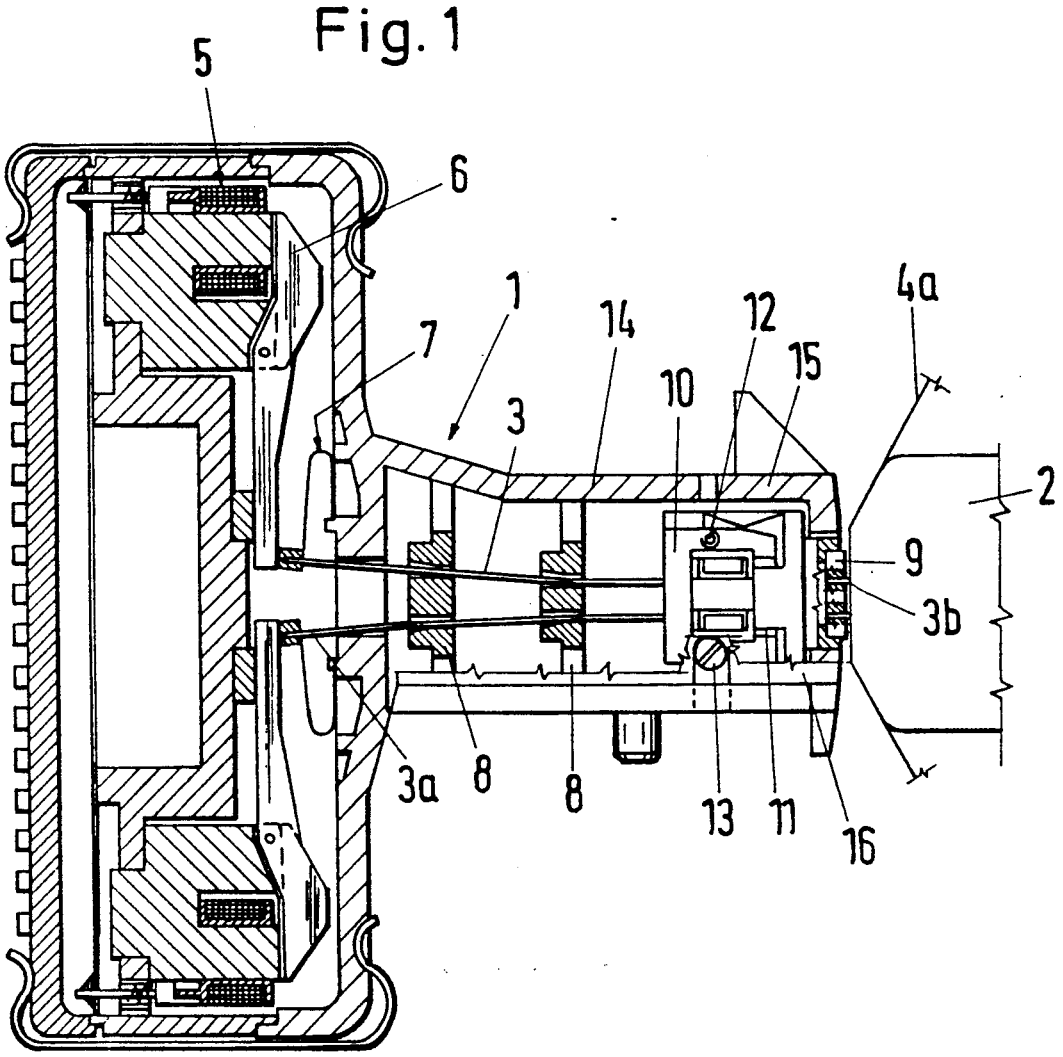
FIG. 1 is an axial, longitudinal sectional view through a matrix pin print head with a lifting magnet device.
Figure 2:
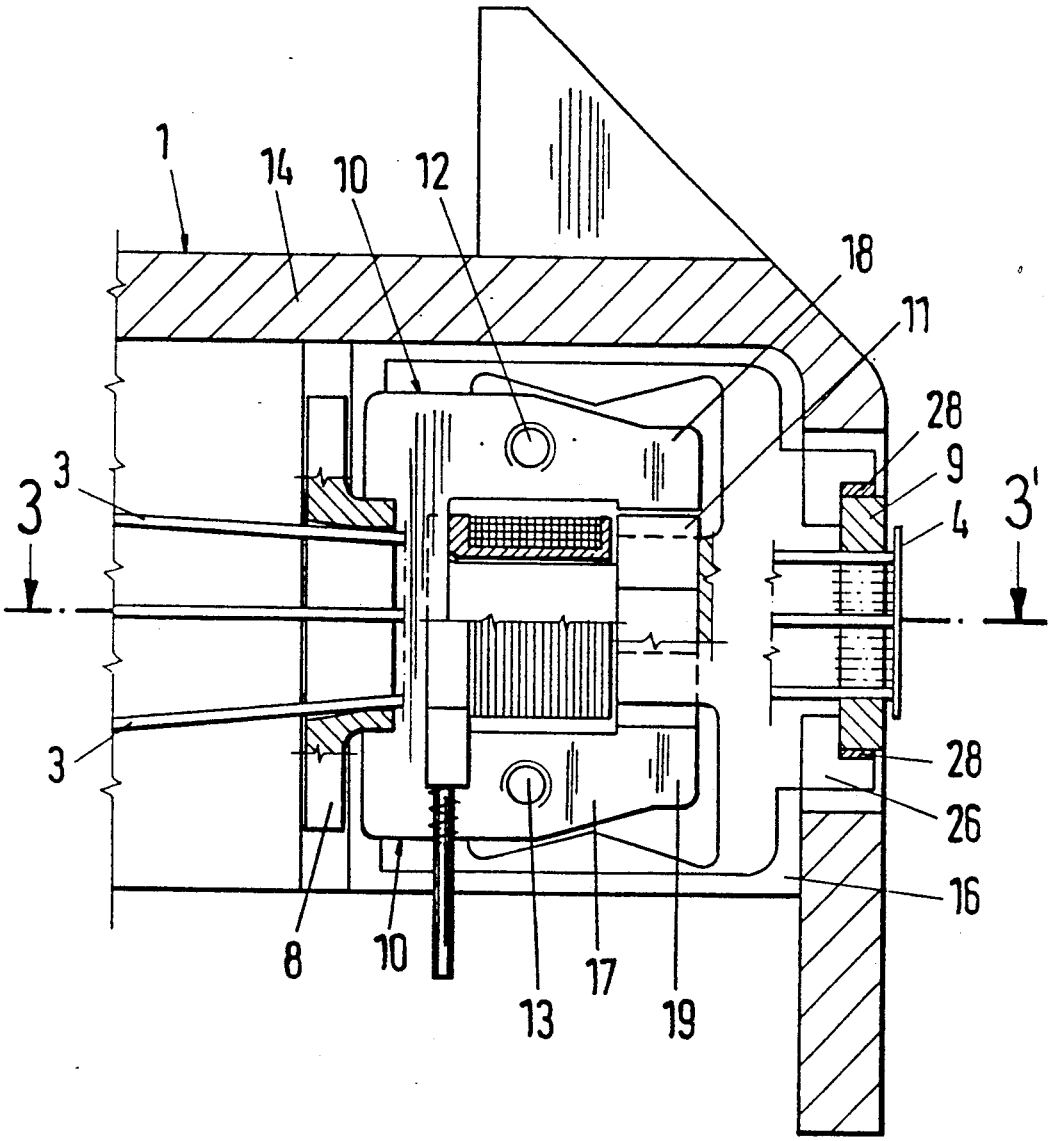
FIG. 2 is a view of the front part of the axial, longitudinal sectional view illustrated in FIG. 1 at an enlarged scale.

The present invention provides for a matrix pin print head 1 with several print pins 3. In each case an electromagnetic drive 5 is coordinated to a rear end 3*a* of the print pin 3 for generating a longitudinal motion of the print pins 3, in order to generate print dots on a recording substrate 4*a*. Front ends 3*b* of the print pins 3 in each case form slots 3*c* or rows in a back and forth or, respectively, up and down movable guide mouthpiece 9. A lifting magnet device 10 is furnished for two defined end positions of a magnet armature 11. The lifting magnet device 10 is altogether disposed and attached, respectively, in a region 15 immediately adjacent to the guide mouthpiece 9. The lifting magnet device 10 exhibits a magnet yoke 17 with two or more magnet poles 18, 19. An armature body 21 is movable back and forth or, respectively, up and down between a predetermined and coordinated distance 20 of two unlike magnet poles 18, 19 by a switching on or switching off, or by change of polarity of a switched-on lifting magnet coil 22. The guide mouthpiece 9 is attached at the guided armature body 21.

The lifting magnet device 10 can be disposed altogether within a matrix print head casing 14 between a frontmost print pin guide support 8 and the guide mouthpiece 9.

The stroke magnet device 10 can exhibit an E-shaped yoke 23. A center yoke arm 24 of the E-shaped yoke 23 can support the lifting magnet coil 22.

The armature body 21 of the lifting magnet device 10 can be furnished with a permanent magnet 25. The lifting magnet coil 22 can be changed in polarity.

A mouthpiece support 26 can be hingedly attached at the magnet yoke 17. The mouthpiece support 26 can exhibit at least two parallel running arms 26*a*, 26*b*. The arms 26*a*, 26*b* can be hingedly attached to a rocker 26*c* and to the magnet yoke 17. The rocker 26*c* can be in each case rigidly connected to the armature body 21 and to the guide mouthpiece 9.

The mouthpiece support 26 can be formed of one single piece made of an elastic material. Hinge positions 27 can be formed by film hinge joints 27*c*.

The guide mouthpiece 9 can be adhesively attached in the mouthpiece support 26.

The matrix pin print head 1 is moved back and forth perpendicular to the plane of projection in front of a print substrate support 2 of a matrix printer and generates with print pins 3 print dots, letters, characters, graphic illustrations and representations, pictures and the like, via an inking ribbon 4 on a recording substrate 4*a*.

The matrix pin print head 1 comprises essentially an electromagnetic drive 5 with, in each case, an armature 6, where the electromagnetic drive 5 is disposed in the rear region of the matrix pin print head 1. The armature 6 in each case drives a print pin 3, which is pressed continuously to the armature 6 with its rear end 3*a* by a restoring spring 7.

The print pins 3 are guided in a front region of the matrix pin print head 1 in several print pin guide supports 8 and the front ends 3*b* of the print pins 3 form vertical slots 3*c* or angled rows in a guide mouthpiece 9. At least one of the slots 3*c* is adjustable in height. For this purpose, a lifting magnet device 10 with a magnet armature 11 is used, where the magnet armature 11 is adjustable into an upper and a lower end position. The complete lifting magnet device 10 is attached with two screws 12 and 13 at a matrix print head casing 14, which print head casing 14 surrounds the print pins 3 on three sides, as illustrated in FIG. 1.

The lifting magnet device 10 is disposed altogether immediately adjacent to the guide mouthpiece 9, in order to generate particularly short connection pieces between the magnet armature 11 and the guide mouthpiece 9. This immediately adjacent region 15 can be disposed at the matrix print head casing 14 above, below, to the left, or to the right of the guide mouthpiece 9 or it can also be disposed in an inner space 16, as illustrated.

Figure 3A:
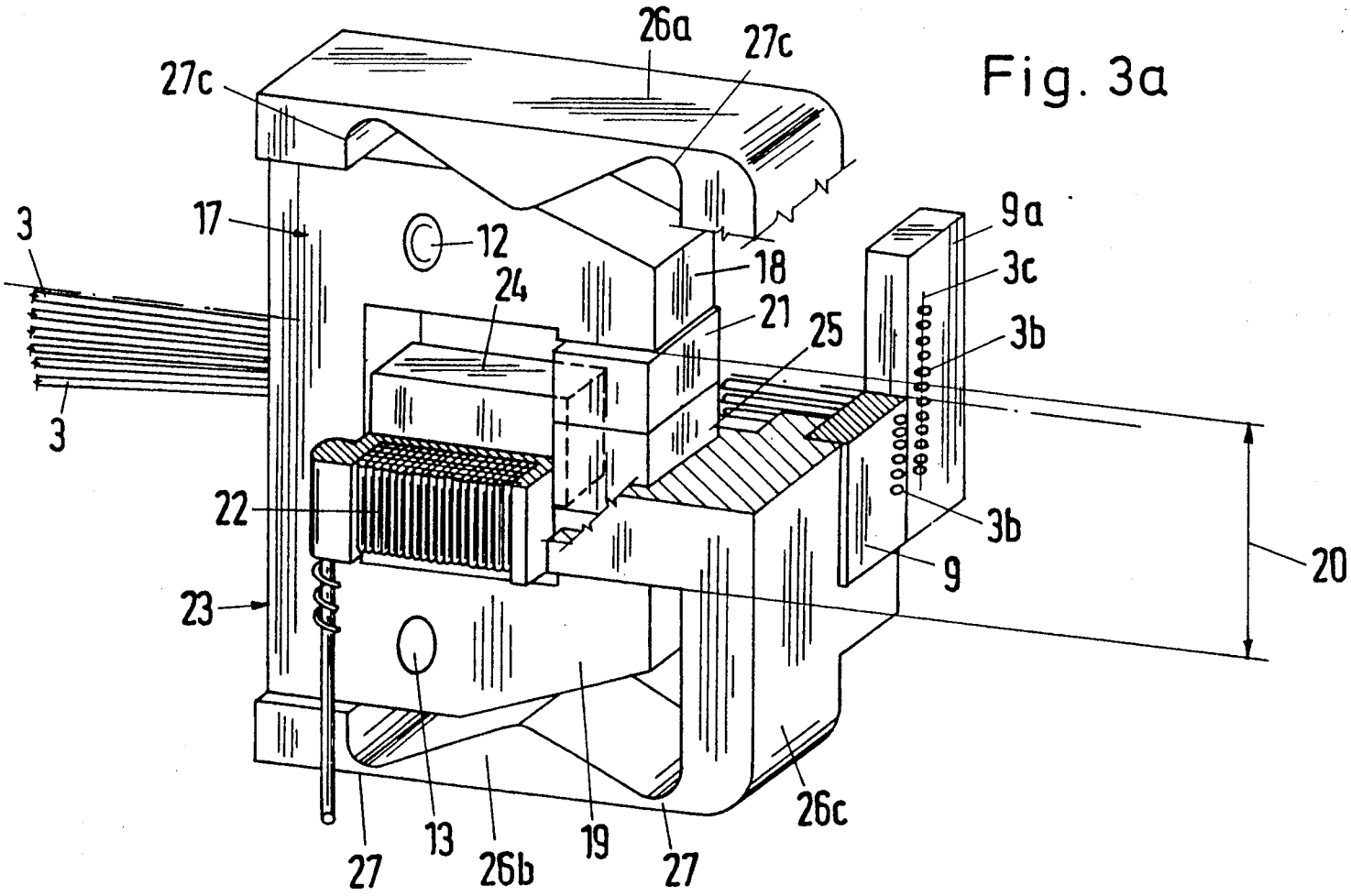
FIG. 3*a* is a perspective, partially sectional view of the lifting magnet device.

The lifting magnet device 10 exhibits further a magnet yoke 17. The magnet yoke 17 forms magnet poles 18 and 19. The magnet poles 18 and 19 are machine-made and are disposed at a distance 20, determined by and coordinated to the motion path of the guide mouthpiece 9. An armature body 21 can move within said distance 20 and thereby move the guide mouthpiece 9. A second guide mouthpiece 9*a* is disposed stationary, as illustrated in FIG. 3*a*.

The armature body 21 can be moved back and forth or up and down, respectively, by switching on or switching off or by changing polarity of a switched-on lifting magnet coil 22, wherein the guide mouthpiece 9 is attached at the armature body 21.

The lifting magnet device 10 can be constructed so small and compact, that it can be disposed altogether within the inner space 16 of the matrix print head casing 14 between the frontmost print pin guide support 8 and the guide mouthpiece 9. One of the particular constructive features of the lifting magnet device 10 is represented by an E-shaped yoke 23, where the center yoke arm 24 of the yoke 23 supports the lifting magnet coil 22.

The armature body 21 can be formed from a single-piece soft iron piece. Alternatively, the armature body 21 can be subdivided, wherein a permanent magnet 25 is furnished as center part, as illustrated in FIG. 3*a*. If the permanent magnet 25 is employed, the lifting magnet coil 22 is to be disposed pole-reverse switchable.

A mouthpiece support 26 is hingedly attached at the magnet yoke 17. The mouthpiece support 26 exhibits two arms 26*a* and 26*b*, running parallel to each other, as well as a rocker 26*c*, hingedly connected to the arms 26*a* and 26*b*. The arms 26*a* and 26*b* are also hingedly connected to the magnet yoke 17, and the rocker 26*c* is in each case rigidly connected to the armature body 21 and to the guide mouthpiece 9.

The mouthpiece support 26 is produced of one single piece made of a plastifiable synthetic material and is consequently sufficiently elastic in order to form hinge positions 27 from so-called film hinge joints 27*c*.

Figure 3B:
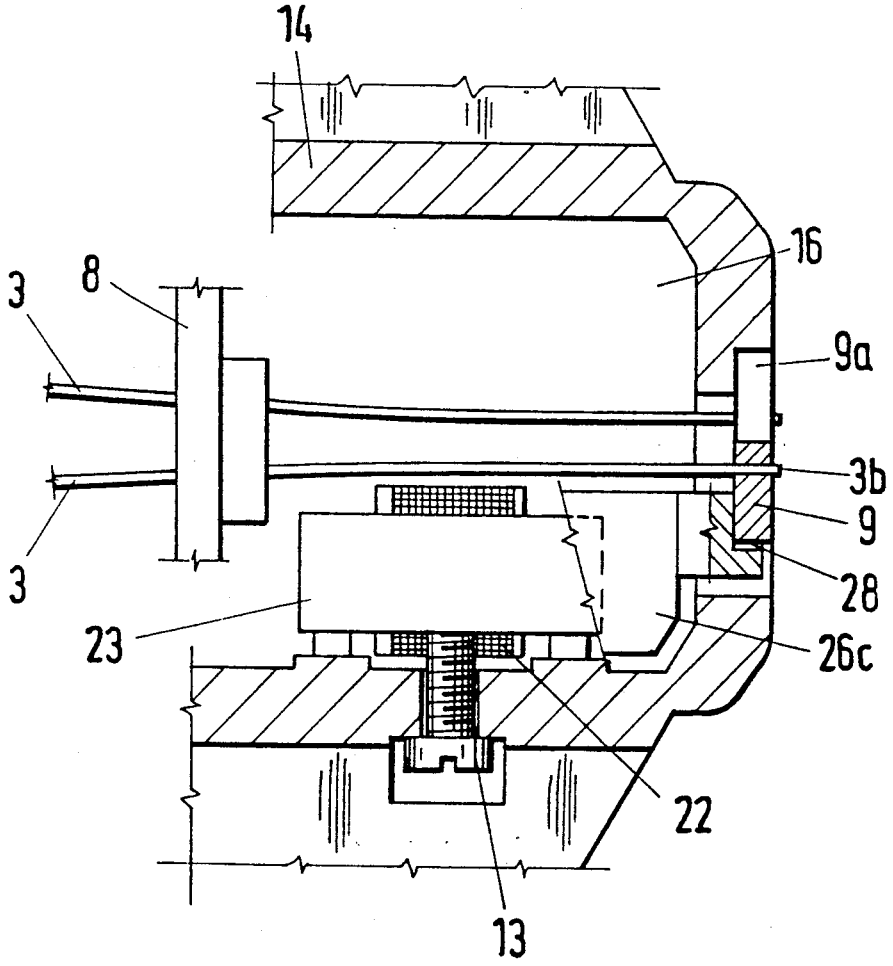
FIG. 3*b* is a horizontal sectional view along section line 3–3' according to FIG. 2 through the lifting magnet device.

The guide mouthpiece 9 is adhesively attached in the mouthpiece support 26 with adhesive material 28 for adjustment purposes such that an alignment between the first guide mouthpiece 9 and the second guide mouthpiece 9*a* can be furnished, as illustrated in FIGS. 3*a* and 3*b*.

In case of a magnet yoke 17 with two magnet poles 18 and 19, advantageously a mechanical spring, not illustrated, is to be furnished for the restoring into the defined end position.

It will be understood that each of the elements described above, or two or more together, may also find a useful application in other types of matrix print heads differing from the types described above.

While the invention has been illustrated and described as embodied in the context of a matrix pin print head with a pin slot adjustment device it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A matrix pin print head, comprising:

a first set of several print pins, where each print pin includes a front end and a rear end;

a second set of several print pins, where each print pin includes a front end and a rear end;

a plurality of electromagnetic drives, wherein each electromagnetic drive is coordinated to each rear end of the corresponding print pin for generating a longitudinal motion of the print pin in order to generate print dots on a recording substrate;

a first guide mouthpiece;

a first column of guide openings formed in said first guide mouthpiece for the front ends of the print pins of the first set, wherein said first guide mouthpiece is movable;

a second guide mouthpiece;

a second column of guide openings formed in said second guide mouthpiece for the front ends of the print pins of the second set, wherein said second guide mouthpiece is stationary relative to the plurality of electromagnetic drives;

a lifting magnet device disposed and attached in a region immediately adjacent to the first guide mouthpiece including an E-shaped magnet yoke including a center yoke arm and two outer magnet arms and furnished at the lifting magnet device, wherein the outer magnet arms are spaced by a certain distance;

an armature body guided between the outer magnet arms and performing motions between two end positions within the certain distance available between the two outer magnet arms, wherein the motions are performed in a direction perpendicular to the longitudinal direction of the print pins by switching of a lifting magnet coil of the lifting magnet device, wherein the first guide mouthpiece is attached at the guided armature body, and wherein the first guide mouthpiece is thereby imparted with the motions of the armature body, wherein the center yoke arm of the E-shaped magnet yoke supports the lifting magnet coil;

a mouthpiece support hingedly attached to the magnet yoke with a hinge;

at least two parallel running arms formed at the mouthpiece support;

a rocker in each case rigidly connected to the armature body and to the first guide mouthpiece;

wherein the parallel running arms are hingedly attached to the rocker and to the magnet yoke with the hinge.

2. The matrix pin print head according to claim 1, further comprising a matrix print head casing; a plurality of print pin guide supports; wherein the lifting magnet device is disposed altogether with the matrix print head casing between a frontmost one of the print pin guide supports and the first guide mouthpiece.

3. The matrix print pin head according to claim 1, further comprising a permanent magnet furnished at the armature body of the lifting magnet device, wherein the lifting magnet coil is changeable in polarity.

4. The matrix print pin head according to claim 1, further comprising film hinges forming in each case hinge positions within the two parallel running arms of the mouthpiece support; wherein the mouthpiece support is formed of one single piece made of a material resilient to bending.

5. The matrix pin print head according to claim 1, wherein the first guide mouthpiece is adhesively attached in the mouthpiece support.

6. A matrix pin print head (1) comprising several print pins (3) with each one of the several print pins (3) having a front end and a rear end;

several electromagnetic drives (5), wherein each one of the electromagnetic drives is coordinated to a rear end (3*a*) of one of the several print pins (3) for generating a longitudinal motion of the several print pins (3) in order to generate print dots on a recording substrate (4*a*);

a bidirectionally movable guide mouthpiece (9);

a mouthpiece support (26) which supports the bidirectionally movable guide mouthpiece (9), wherein the mouthpiece support (26) includes at least two parallel running arms (26*a*, 26*b*);

several guide openings (3*c*) furnished in the bidirectionally movable guide mouthpiece (9) and forming a column, wherein the front end of each one of the several print pins passes through a corresponding one of the several guide openings;

a rocker, wherein the arms (26*a*, 26*b*) of the mouthpiece support are hingedly attached to the rocker (26*c*), wherein the rocker (26*c*) is in each case rigidly connected to the guide mouthpiece (9);

an armature body (21) mechanically connected to the bidirectionally movable guide mouthpiece (9), wherein the armature body is disposed so as to be capable of assuming two defined end positions, and wherein the rocker (26*c*) is in each case rigidly connected to the armature body (21);

a lifting magnet device (10) including a lifting magnet coil (22) and an E-shaped magnet yoke (23), wherein the E-shaped magnet yoke (23) includes a center yoke pole (24) and two outer magnet poles (18, 19), wherein the center yoke pole of the E-shaped magnet yoke (23) supports the lifting magnet coil (22), and wherein the armature body (21) is movable in two directions up and down between the two outer magnet poles (18, 19) by switching a feeding of power to the lifting magnet coil (22), and wherein the mouthpiece support (26) is hingedly supported, and wherein the mouthpiece support (26) is hingedly attached to the E-shaped magnet yoke (23) with a hinge (27).

7. The matrix pin print head according to claim 6, further comprising a matrix print head casing (14);

a frontmost print pin guide support (8), wherein the lifting magnet device (10) is disposed altogether within the matrix print head casing (14) between the frontmost print pin guide support (8) and the guide mouthpiece (9).

8. The matrix pin print head according to claim 6 wherein the E-shaped yoke (23) is incorporated in the lifting magnet device (10), and wherein the center yoke pole (24) of the E-shaped yoke (23) supports the lifting magnet coil (22) and wherein the outer magnet poles are equidistant from the center yoke pole.

9. The matrix pin print head according to claim 6, wherein the armature body (21) of the lifting magnet device (10) is furnished with a permanent magnet (25), and wherein the lifting magnet coil (22) is changeable relative to its polarity.

10. The matrix pin print head according to claim 6 further comprising film hinges (27*c*), wherein the mouthpiece support (26) is formed of one single piece made of a material resilient to bending, and wherein hinge positions (27) are formed by the film hinges (27*c*).

11. The matrix pin print head according to claim 6, wherein the movable guide mouthpiece (9) is adhesively attached in the mouthpiece support (26).

12. A matrix pin print head, comprising several print pins, wherein each print pin includes a front end and a rear end;

an electromagnetic drive coordinated to each rear end of the print pins for generating a longitudinal motion of the print pin;

a movable guide mouthpiece having a first column of guide openings for guiding corresponding print pins in the area of their respective front ends;

a stationary guide mouthpiece having a second column of guide openings for guiding corresponding print pins in the area of their respective front ends;

a lifting magnet device disposed neighboring to the movable guide mouthpiece and including an E-shaped magnet yoke having two outer magnet poles spaced at a certain distance and a center magnet pole;

an armature body having side faces and guidedly disposed between the outer magnet poles and facing the center magnet pole with one of the side faces of the armature body, wherein the armature body performs motions between two end positions within the certain distance available between the two outer magnet poles, wherein the motions are performed in a direction perpendicular to the longitudinal direction of the print pins by stitching a lifting magnet coil of the lifting magnet device, dual hinged arms wherein the movable guide mouthpiece is supported by said dual hinged arms, attached to the E-shaped magnet yoke and to the movable guide mouthpiece, and is engaged by the guided armature body, and wherein the movable guide mouthpiece is thereby imparted with the motions of the armature body.

13. The matrix pin print head according to claim 12 further comprising a frame of the matrix print head;

a film hinge attaching the movable guide mouthpiece to the frame.

14. The matrix pin print head according to claim 12, further comprising a permanent magnet furnished at the armature body of the lifting magnet device, wherein the lifting magnet coil is changeable in polarity.

15. The matrix pin print head according to claim 12, further comprising film hinges forming in each case hinge positions within the dual hinged arms of the guide mouthpiece, forming a mouthpiece support;

wherein the mouthpiece support is formed of one single piece made of a material resilient to bending.

16. The matrix pin print head according to claim 12, wherein the movable guide mouthpiece is adhesively attached to the mouthpiece support.

17. A matrix pin print head, comprising several print pins, wherein each print pin includes a front end and a rear end;

an electromagnetic drive coordinated to each rear end of the print pins for generating a longitudinal motion of the print pin;

a movable guide mouthpiece including a first column of guide openings formed in the movable guide mouthpiece for guiding the front ends of the print pins in their respective front end area;

a stationary guide mouthpiece including a second column of guide openings formed in the stationary guide mouthpiece for guiding the front ends of the print pins in their respective front end area, wherein the stationary guide mouthpiece is stationary relative to the electromagnetic drive;

a lifting magnet device;

a magnet yoke having two outer magnet poles and a center magnet pole and furnished at a lifting magnet device, wherein the two outer magnet poles are magnet poles of the same polarity and are spaced by a certain distance;

a permanent magnet armature body guided between the outer magnet poles and performing motions between two end positions within the certain distance present between the two outer magnet poles;

means transferring a motion of the armature body to the movable guide mouthpiece including two parallel running arms and wherein the two parallel running arms actuate the movable guide mouthpiece for performing a motion corresponding to the motion of the armature body.

18. The matrix pin print head according to claim 17 wherein the center magnet pole of the magnet yoke exhibits a polarity opposite to that of said two outer magnet poles of the same polarity, upon energization of the magnet yoke with a coil, wherein the center magnet pole is disposed to engage the armature body from the side such that upon a switching of the polarity of the magnet yoke the armature body changes into an alternate position.

19. The matrix pin print head according to claim 17, wherein the magnet yoke exhibits an E-shape with the two outer magnet poles forming upper and lower arms of the E-shape, and wherein the center magnet pole of the magnet yoke corresponds to a middle arm of the E-shape, and herein the outer magnet poles are equidistant from the center magnet pole.

20. The matrix pin print head according to claim 17 further comprising a frame of the matrix print head;

a film joint attaching the movable guide mouthpiece to the frame.

21. The matrix pin print head according to claim 17 wherein the stationary guide mouthpiece supports and guides the print pins not to be switched in their respective impact position in a vertical direction.

* * * * *